US005778604A

United States Patent [19]

Snow

[11] Patent Number: 5,778,604

[45] Date of Patent: Jul. 14, 1998

[54] STORAGE BUILDING WITH RAM OPENABLE ROOF

[76] Inventor: Guy B. Snow, 1036 O St., Rio Linda, Calif. 95673

[21] Appl. No.: 747,972

[22] Filed: Nov. 12, 1996

[51] Int. Cl.[6] ..... E04H 1/12; E04B 7/16; E04B 1/344

[52] U.S. Cl. ..... 52/66; 52/36.2; 52/64; 52/71; 52/DIG. 17; 220/264; 220/335

[58] Field of Search ..... 52/36.1, 36.2, 52/64, 66, 68, 71, 72, 79.1, 641, DIG. 17; 220/211, 263, 264, 335

[56] References Cited

U.S. PATENT DOCUMENTS

| | | | |
|---|---|---|---|
| 2,293,569 | 8/1942 | Sonino | 52/71 |
| 2,350,904 | 6/1944 | King | 52/641 X |
| 2,766,859 | 10/1956 | Urquhart | 52/72 X |
| 2,805,884 | 9/1957 | Kinsman | 52/66 X |
| 3,009,211 | 11/1961 | Hansen et al. | 52/66 |
| 3,182,581 | 5/1965 | Von Poederoyen et al. | 52/72 X |
| 3,353,311 | 11/1967 | McClure et al. | 52/66 |
| 3,667,172 | 6/1972 | Erickson | 52/64 |
| 4,035,965 | 7/1977 | Ronai | 52/66 |
| 4,167,838 | 9/1979 | Metheny | 52/DIG. 17 X |
| 4,210,358 | 7/1980 | Sweet et al. | 220/211 X |
| 4,456,272 | 6/1984 | Kroeger | 52/36.2 X |
| 4,570,392 | 2/1986 | Oltman et al. | 52/64 |
| 5,078,442 | 1/1992 | Rau et al. | 52/66 X |
| 5,363,608 | 11/1994 | Conlan | 52/79.1 |
| 5,369,920 | 12/1994 | Taylor | 52/71 X |
| 5,501,043 | 3/1996 | Park | 52/92.1 |
| 5,566,403 | 10/1996 | Black et al. | 220/264 X |

FOREIGN PATENT DOCUMENTS

| | | | |
|---|---|---|---|
| 347308 | 6/1907 | France | 52/64 |
| 4-14562 | 1/1992 | Japan | 52/71 |
| 8501854 | 1/1987 | Netherlands | 52/72 |
| 305988 | 6/1955 | Switzerland | 52/66 |
| 455562 | 10/1936 | United Kingdom | 52/71 |
| 1062690 | 3/1967 | United Kingdom | 220/211 |

*Primary Examiner*—Carl D. Friedman
*Assistant Examiner*—Laura A. Callo
*Attorney, Agent, or Firm*—Mark C. Jacobs, Esq.

[57] ABSTRACT

A storage shed of a height less than that of an adult person, and which is accessed through a front door or ramp, when the roof portions are in an open supported position. The shed is intended for use in locations where local regulations prevent the placement of buildings that exceed the height of a residential fence. The superstructure of the shed; namely, the walls and roof portion(s) is formed of metal frame members which are covered over with a plywood or vinyl siding. The roof covering may be corrugated galvanized sheeting, or wood optionally covered by shingles as well as transparent or translucent plastic. The roof may be opened and closed by the operation of a series of water operated or electrically operated rams.

21 Claims, 14 Drawing Sheets

STORAGE BUILDING WITH RAM OPENABLE ROOF

FIELD OF THE INVENTION

This invention pertains to the field of storage buildings, preferably portable storage buildings, of minimum height with OPENABLE roof sections to permit access to the interior of the building without bending or crawling.

BACKGROUND OF THE INVENTION

Beginning back in the days of the presidential administration of Lyndon Johnson, and especially due to his wife Lady Bird, Americans have being paying attention to the natural beauty of the environment. Laws, ordinances and CC&Rs have been passed to protect the citizenry against blight and unsightly items that interfere with the enjoyment of everyday life. In accordance with this line of thinking, many communities have passed regulations governing not only the height of buildings, (zoning restrictions) but also the ability to place extra buildings and sheds on one's property.

Other communities, have taken a different approach, more like if I don't see it, it is not there. Thus restrictions have been placed on the height of storage buildings and sheds in certain residential communities, such that these structures are not to be visible to the casual viewer along the sidewalk or curb. That is, no separate shed or other structure can exceed the height of the fencing ordinance. Usually that is a height of from 6 to about 8 feet in elevation.

It is because of the existence of a restriction of this nature that the invention of this application was conceived.

It is an object therefore to provide a walk-in storage shed that does not exceed the height of the fence of most communities.

It is another object to provide a storage shed that has an openable roof to permit access without stooping by both men and women.

It is still another object to provide a storage shed whose openable roof is power operated by water power or electricity.

It is yet another object to provide a storage building that can be made in any length as deemed appropriate, and which can be assembled by one person working alone.

Other objects of the invention will in part be obvious and will in part appear hereinafter.

The invention accordingly comprises the device possessing the features properties and the relation of components which are exemplified in the following detailed disclosure and the scope of the application of which will be indicated in the appended claims.

For a fuller understanding of the nature and objects of the invention reference should be made to the following detailed description, taken in conjunction with the accompanying drawings.

SUMMARY OF THE INVENTION

A storage shed, which when the roof is closed, is of a height less than that of an adult person, and which is intended for access through a front door or ramp, when the roof portions are in an open supported position. The shed is intended for use in locations where local regulations prevent the placement of buildings that exceed the height of the fence, often six feet.

The superstructure of the shed, including the front, rear side walls and roof portions is formed of metal frame members which are covered over with an enclosing skin such as plywood or vinyl siding. The roof covering may be corrugated galvanized sheeting or wood covered by shingles or other opaque material; as well as transparent plastic.

The roof may be opened and closed by the operation of a series of water operated or electrically operated rams.

DESCRIPTION OF THE PREFERRED EMBODIMENT

Figure 1:
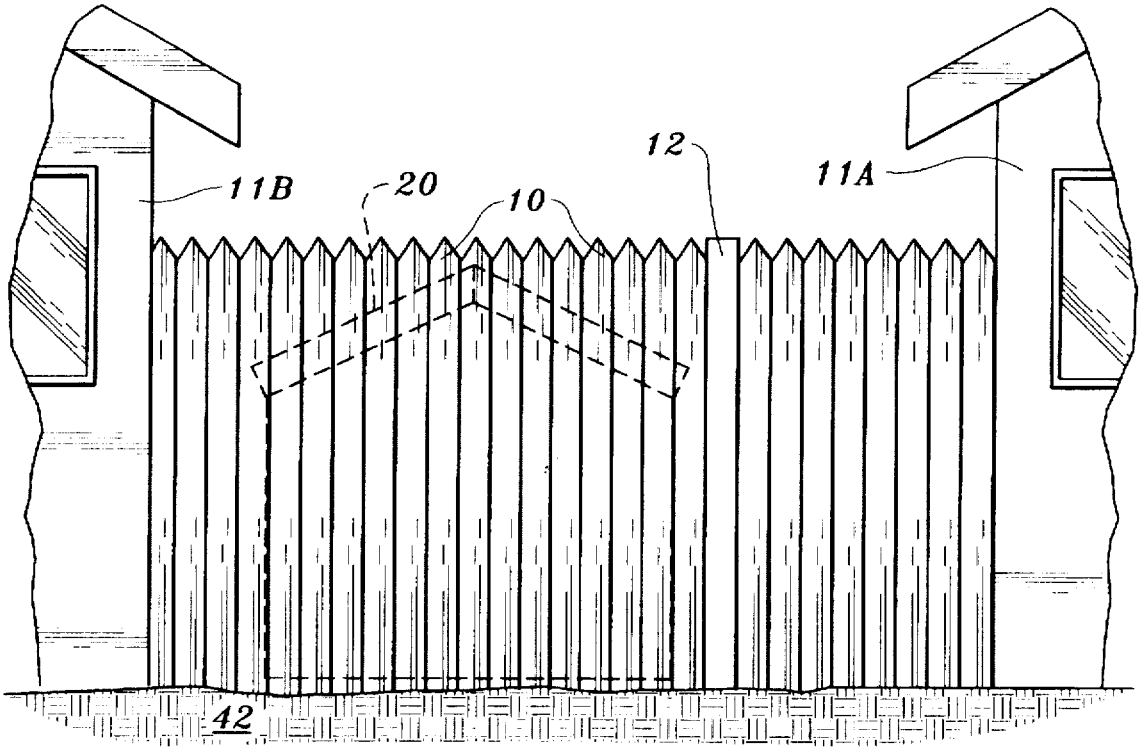
FIG. 1 is an elevational view of a six foot fence with the shed of this invention shown in dashed line behind the fence.

The discussion first turns to FIG. 1. Here a typical suburban front fence 10 between adjacent neighbors is seen. The boundary line fence which marks the line of demarcation between the two houses 11A and 11B can not be seen. Nor can the inventive apparatus 20 of this application be seen, yet it is there present behind the fence.

Figure 2:
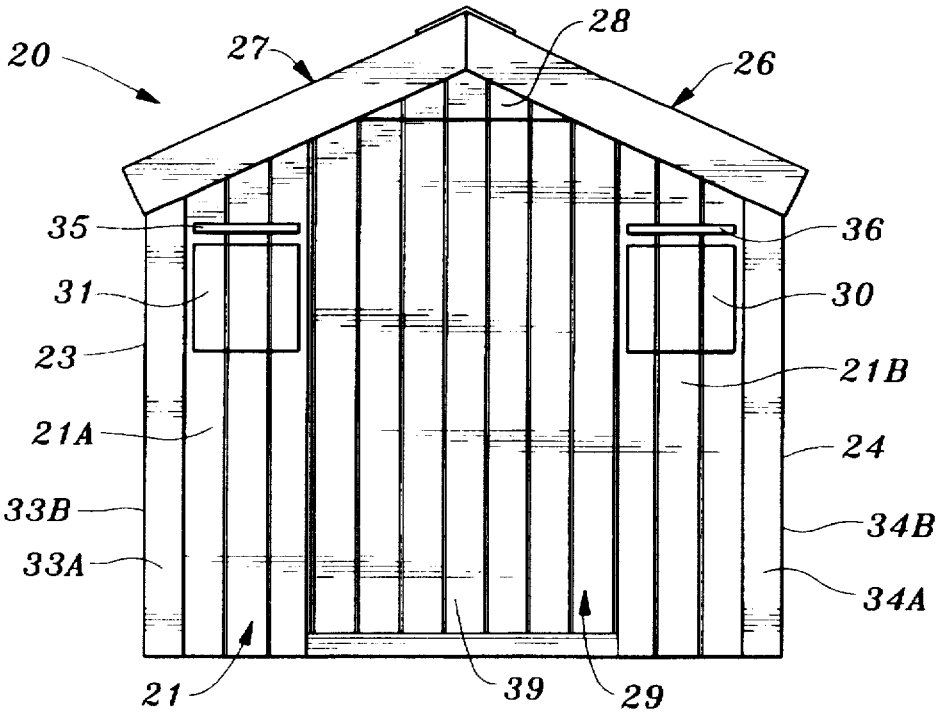
FIG. 2 is a front elevational view of the shed of this invention.

In FIG. 2 apparatus 20, the storage shed of this invention is seen to be disposed behind front fence 10, positioned between the house 11A and side fence 12. In this view the elevation of the roof of apparatus 20 is seen to be below the height of the front fence 10.

As in most buildings, the walls constitute a covering over a section of the superstructure. In most homes, other than Hawaii, a dual wall construction is used. Siding or brick fascia covers over the studs and joists, while lath and plaster or wall board covers over the interior side of the studs etcetera that form the superstructure. Here, only a single outer covering or wall is used over the superstructure sections.

Thus from FIGS. 2, 4, 5 and 22, it is seen that the apparatus 20 has a front wall 21 of two parts 21A, 21B, both spaced from a rear wall 22, which also may optionally have two panels 22A and 22B and spaced side walls, 23 and 24 normally disposed to the front and rear walls aforementioned. Whereas access is to be gained via the front ramp 29 to be discussed infra, if the apparatus is placed up close to fence 10, rear entry through a door 41 or a second ramp would be impossible. In such situations, a solid rear wall 22 may be employed.

The front wall 21 has a ramp 29 disposed between each of the two wall sections 21A and 21B, and a generally triangular section 28 disposed above the ramp 29 and above the optional rear door 41. The size of each of the two triangular sections 28 need not be the same. The actual dimensional size will vary with the elevation of the respective door or ramp. In these figures the walls are seen to be constructed of plywood siding. For both cosmetic and weatherproofing purposes, L-shaped trim corners which are elongated members usually of metal or vinyl are employed. These are designated 33A, 33B, 34A and 34B. See FIGS. 3 and 22.

Each of the front wall sections 21A, 21B has a valve access panel 30, 31 leading to the respective side's roof opening controls—to be discussed infra under Building Accesses—. Each panel 30, 31 has a panel protector 35, 36 optionally disposed above the panel for one or more of (a) reinforcement of the opening of the panel, and (b) to serve as a hinge source for the hinge 38 of the respective panel, as well as (c) a weather protector to prevent rain from entering through the slot separating the hinged panel from the wall itself.

Figure 3:
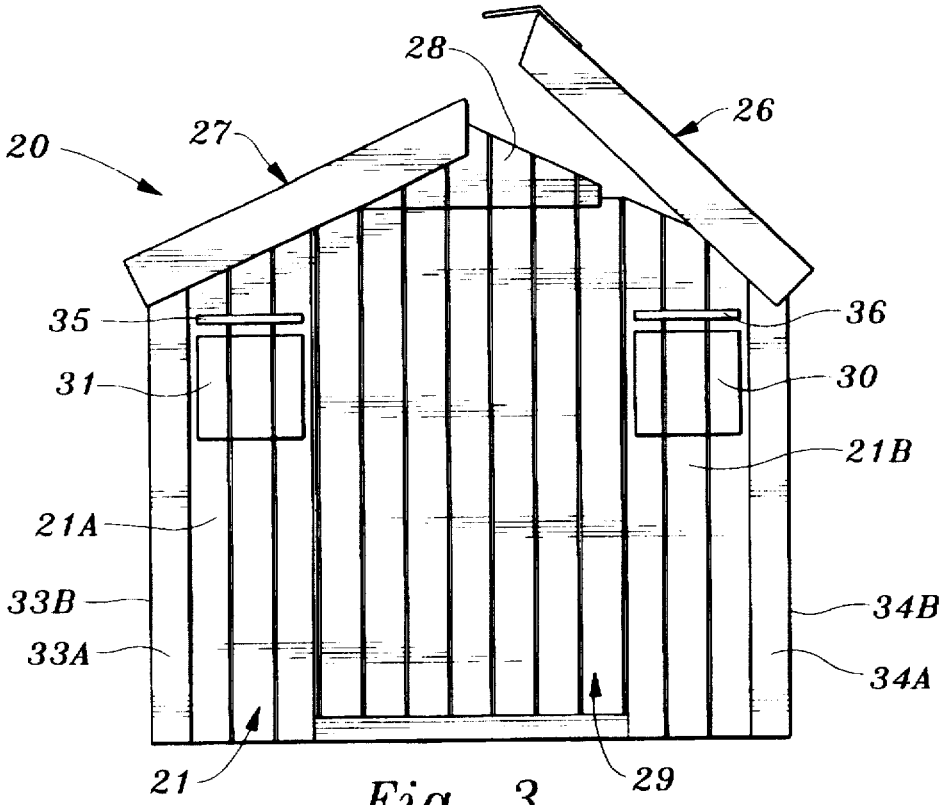
FIG. 3 is a view similar to FIG. 2 with the roof partially open.
Figure 4:
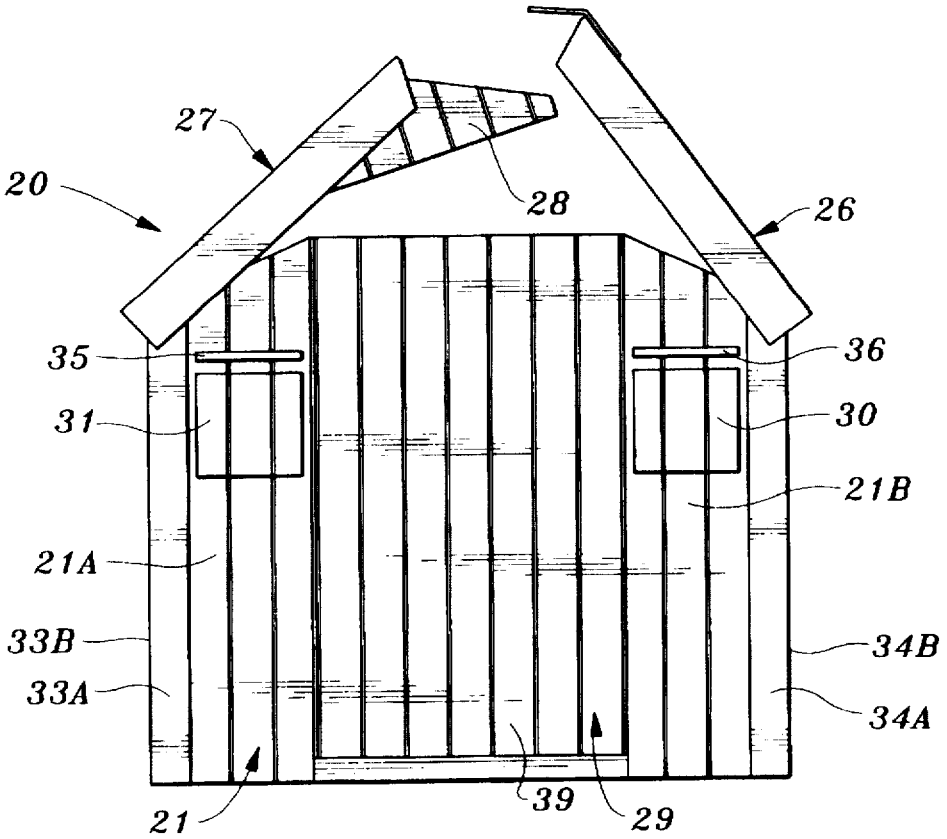
FIG. 4 is a similar view at a point later in time with both sides of the roof partially open.

The reader's attention is directed to FIGS. 3 and 4 which show that the triangle section 28 is attached to the roof, even though disposed as part of the front wall, 21. FIGS. 2 and 3 also depict the presence of roof trim sections 26 and 27 which may also be L-shaped and made of the same material as trim corners 33, 34. Roof cap 32, also called a ridge cap, is an obtuse angled member, of metal or plastic, attached to one side of the roof on ridge board 108. Here the roof cap 32 is attached on the right side 26 of the roof, as seen from the front of the apparatus, and runs the full length of the structure. It is used to keep water out of the space between the two halves of the openable roof structure; namely, 26, 27—per FIG. 2. The rear door 29 will be discussed infra.

As is further noted from FIG. 3, ramp 29 is spaced up slightly from the ground, surface 42, to permit adequate rotational room up and down for the operation of the ramp.

Figure 5:
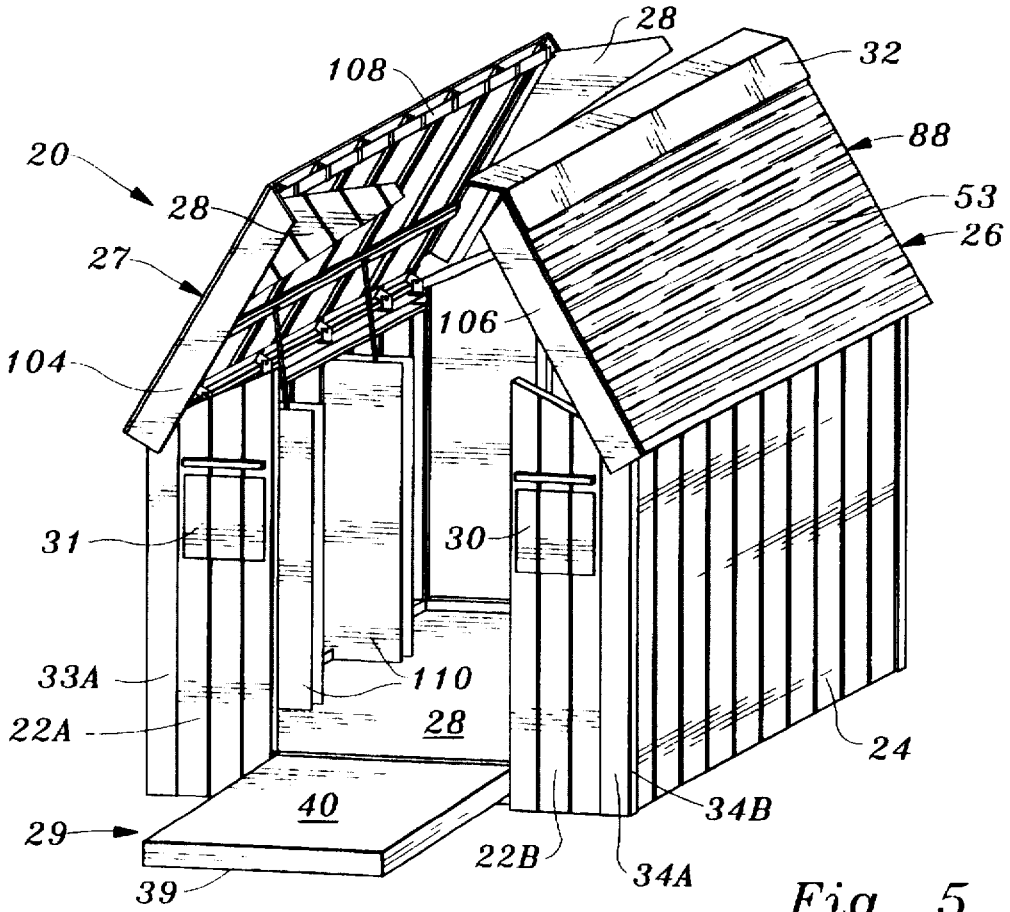
FIG. 5 is a front perspective view taken slightly closer than FIG. 4 at a later point in time when both roof portions are in the open position and the front door/ramp down.

FIG. 5 is a closer up front perspective view of the shed of this invention with the roof open to reveal the two portions of the roof superstructure 88. Each triangle section 28, front and rear is attached to a roof trim corner 104, 106. Several of the ram housings 110 to be discussed infra are visible here. These each hold a hydraulic or electrically operated ram, which is used to raise and lower a respective roof section.

In FIG. 2, the front ramp is designated 29. This ramp is formed of an exterior panel 39, often plywood, mated to a similarly sized interior panel 40, seen in FIG. 5 where the ramp is in the lowered position. The interior panel 40 may be made of plastic or plywood, and is glued, screwed or otherwise attached to the front panel 39.

Figure 6:
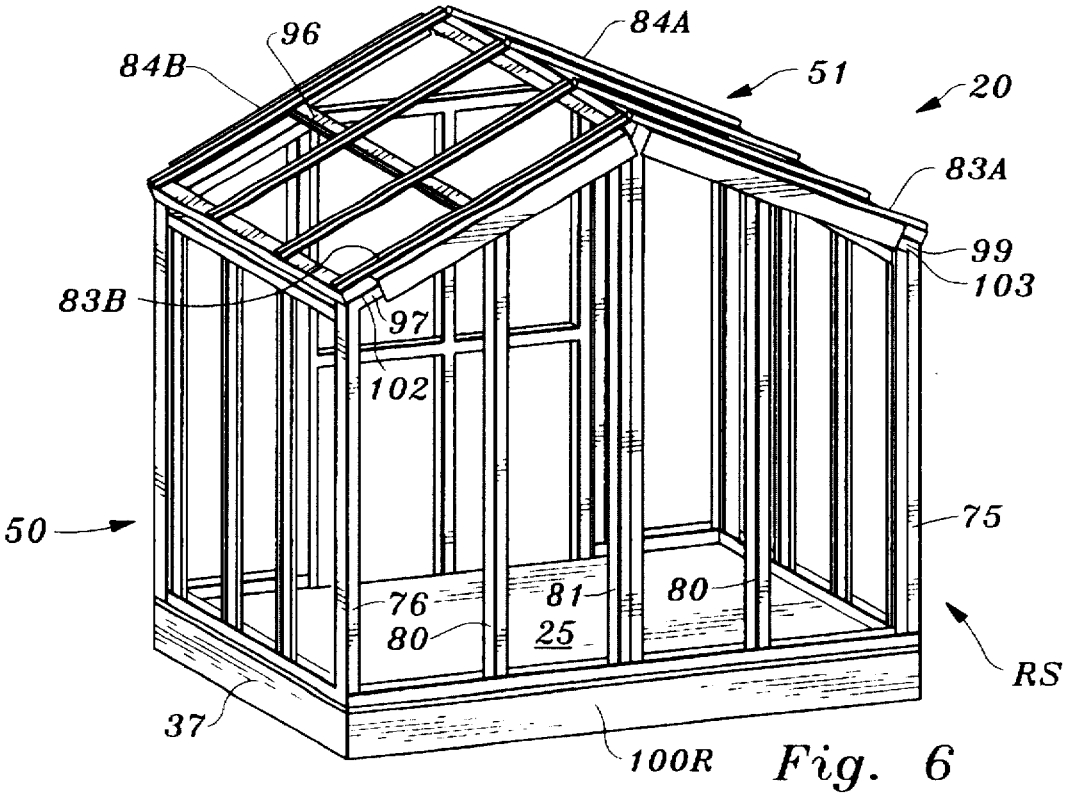
FIG. 6 is a rear perspective view of the framework or superstructure of the shed of this invention.

The discussion now moves to a review of FIG. 6, wherein the superstructure of a typical shed according to this invention is seen. While the shed of FIG. 6 is dimensionally smaller in depth than the yard located completed shed of FIGS. 1–5, its mode of construction is the same. The unit depicted in FIG. 6 et. seq. lacks the outside wall coverings of its larger cousin depicted in FIGS. 2–5. As mentioned earlier, the rear access to the shed 20 be it by a second ramp or a door is optional. In the embodiment shown in FIG. 6,—which is not really a different embodiment, but rather a unit of reduced depth, but full sized across the front and rear walls,—the rear access is not depicted.

In FIG. 6, which is a rear perspective view, element 76 is seen to be a left corner post and element 75 a right corner post. But these will be designated in reverse, since the normal point of reference is at the front of the shed. Thus correctly speaking, the right rear corner post is 76 and the left rear corner post is 75, and both are connected at one end to rear base 100R and to an inclined structural member 97 at their opposite ends. See FIGS. 6 and 12. It is seen that these two corner posts are spaced from each other and disposed generally vertically. Midpoint between the two corner posts aforesaid, is a vertically disposed central stud 81 normally disposed and secured to said rear base member 100R and to inclined structural member 97. Spaced sidewardly from said central stud are a pair of parallel vertical rear studs 80, one on each side thereof, both connected to the base member 100R. Of these 5 vertical members, the central stud is of the highest elevation, as the shed (building) 20 is constructed with a peaked roof. The roof rafters 102 and 103 are seen to connect the two respective corner posts and the rear studs, 80, and central stud 81 to thereby define the rear superstructure section, RS.

Figure 8:
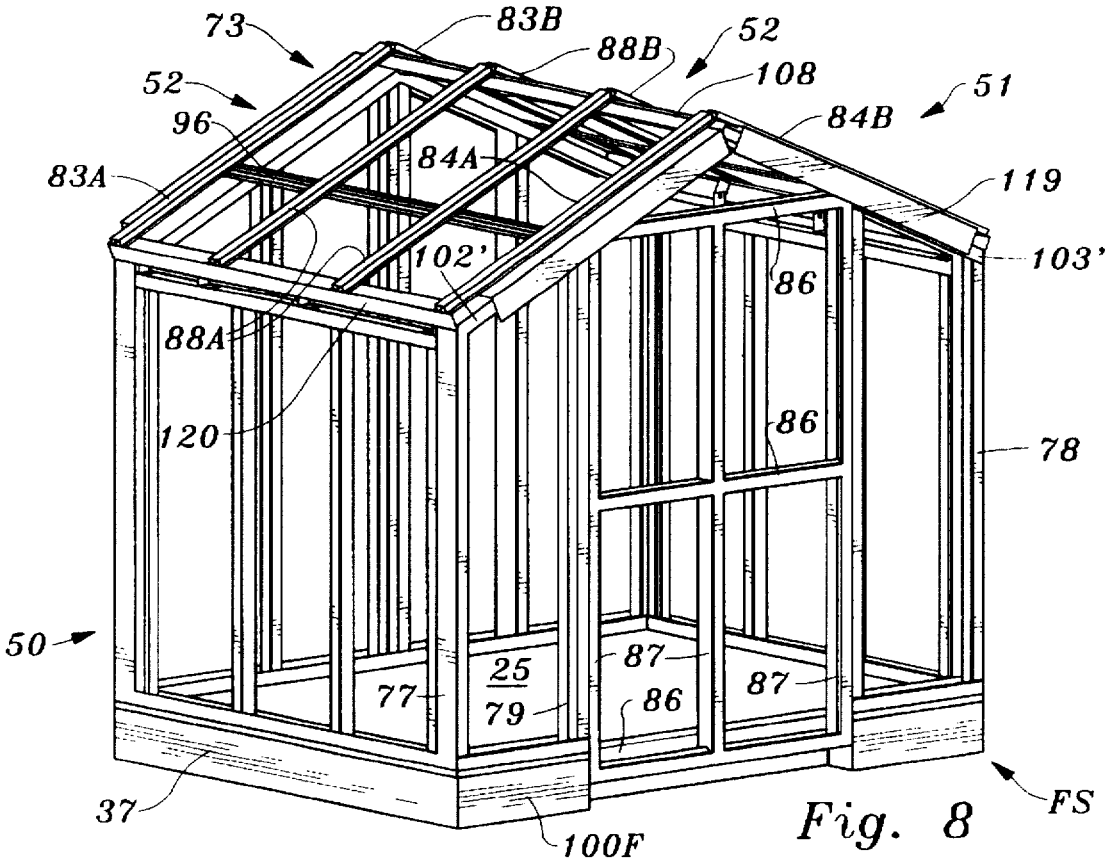
FIG. 8 is a front perspective view thereof.

The front superstructure section FS, is seen as being part of FIG. 8 hereof. This section includes a pair of front corner posts, 77 and 78 which are normally disposed from base member 100F. Spaced inwardly from the two front corner posts, and upwardly from the front base member 100F, are a pair of spaced front intermediate studs 79. Front roof rafter segments 102' and 103' connect the front corner posts to their respective front intermediate stud. As can be seen from FIG. 9, the front roof rafter does not go all the way to the peak for if it were to do so, entrance into building 20 would be impossible without bending down. This section is defined by the base 100F, the two front corner posts 77 and 78, the two spaced intermediate studs, and the roof rafter segments connecting these studs to their respective corners.

Ramp superstructure 85 is defined by the rectangle formed from three vertically spaced cross members 86, and three horizontally spaced door vertical members 87 normally connected to each other. See FIGS. 8 and 9. The elevation of the vertical members 87 is the same as the elevation of the intermediate studs, to which they are adjacent. Note infra. Whether superstructure 85 is used as a ramp or a door is dependent upon the location of hinges or pivot pins used for the opening and closing thereof. See the discussion pertaining to FIG. 14 below.

The front and rear superstructures FS and RS are interconnected at each end of the bottom by a pair of spaced side base members 100S. These are connected to opposite ends of both of base members 100F and 100R. A beam 107 is attached between the upper ends of the respective front and rear left corner posts 75, 77 and the front and rear right corner posts 76, 78. Intermediate side studs 82 are interposed as regular spacings such as every 16, 18 or 24-inches between the respective pairs of front and rear corner posts, disposed between the side beam 107 and the side base 100S. Note especially FIGS. 6 and 9. This completes the superstructure 50 of the shed, but for the roof 51.

Figure 9:
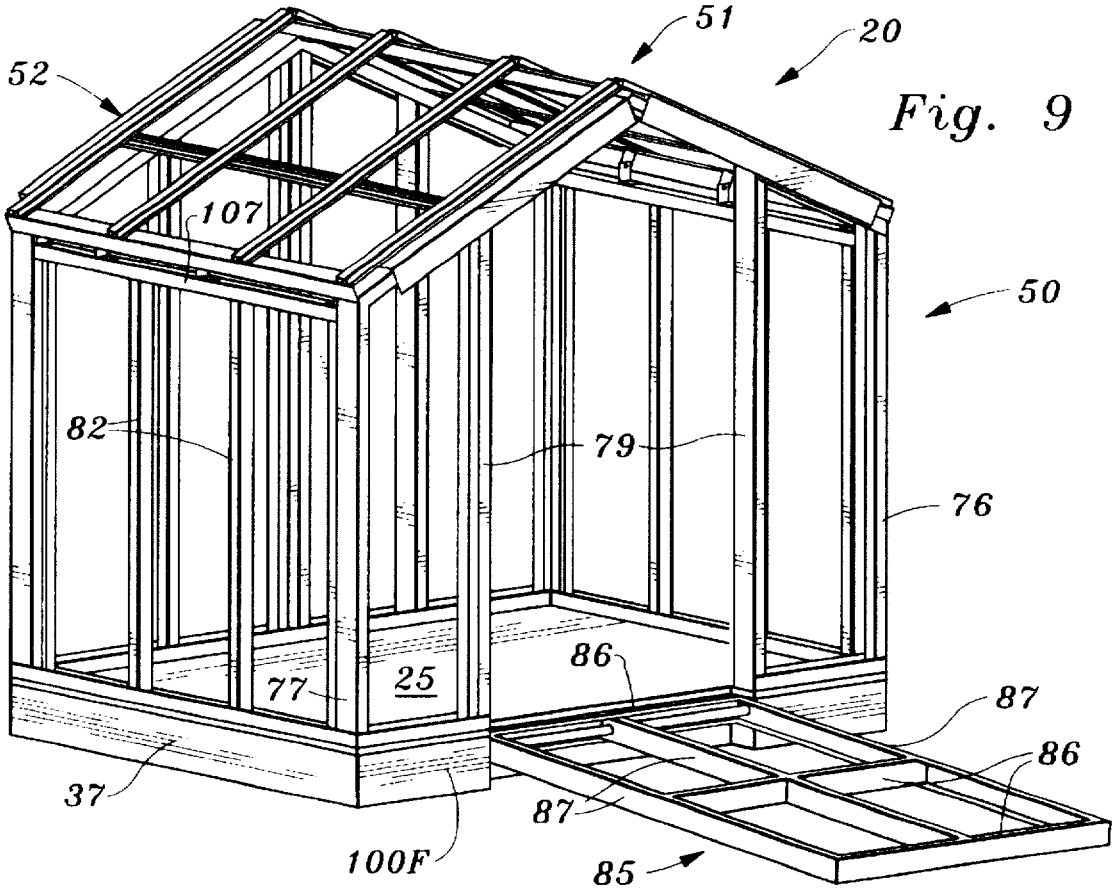
FIG. 9 is a left perspective view with front door down.
Figure 10:
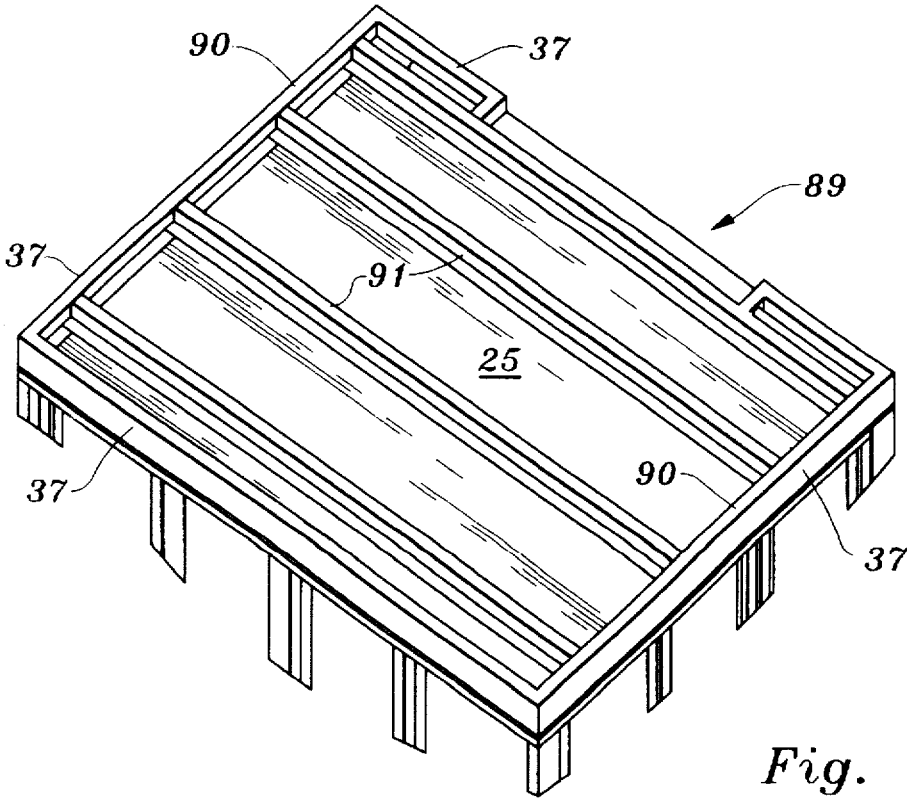
FIG. 10 is a bottom plan view thereof.

The superstructure 50, noted in FIG. 9 does not rest directly on the ground 42, but rather on a floor 25, supported by four floor supports 37 connected end to end to form a rectangle. As seen in FIG. 10, a series of spaced parallel floor cross members 91 connect to the two floor crossmembers 90 and the flooring 25 to provide the floor with extra strength.

The discussion now moves to the roof 51, noted in FIG. 8. The roof 51 is formed in two covered sections, 52 per FIG. 7, both of which are seen to be generally flat structures comprised of a series of spaced parallel members interconnected by cross members. These two roof actions 52 taken together are designated the roof superstructure 73.

Thus each section 52 depicted without its covering or roofing 53 is seen to include a front roof rafter, the right one being 84B, the left one 84A, and each section has a rear roof rafter 83B and 83A respectively. The left roof section 52, includes a plurality of intermediate roof rafters 88A, while the right section has a plurality of intermediate roof rafters 88B. All roof rafters 88, are formed preferably from "hat track" sections—a term known to the roofing art for a product available from several vendors.

A pair of outriggers 120 connect the series of roof rafters at their proximal ends, at predefined spacings. The outriggers preferably may be rectangular stock as shown or hat track as may be desired. Corner fascia 119 are attached to each end roof rafter 83 and 84 to extend away therefrom and downwardly to keep out rain and wind when the roof sections are in their normal closed position. Intermediate horizontal cross members 96 are of hat track stock available from various vendors. The distal connections of each of the roof rafters is to a ridge board 108. In normal roof construction only one of these ridge boards is employed, but since the roof splits to open, two are needed. See FIG. 13.

Figure 7:
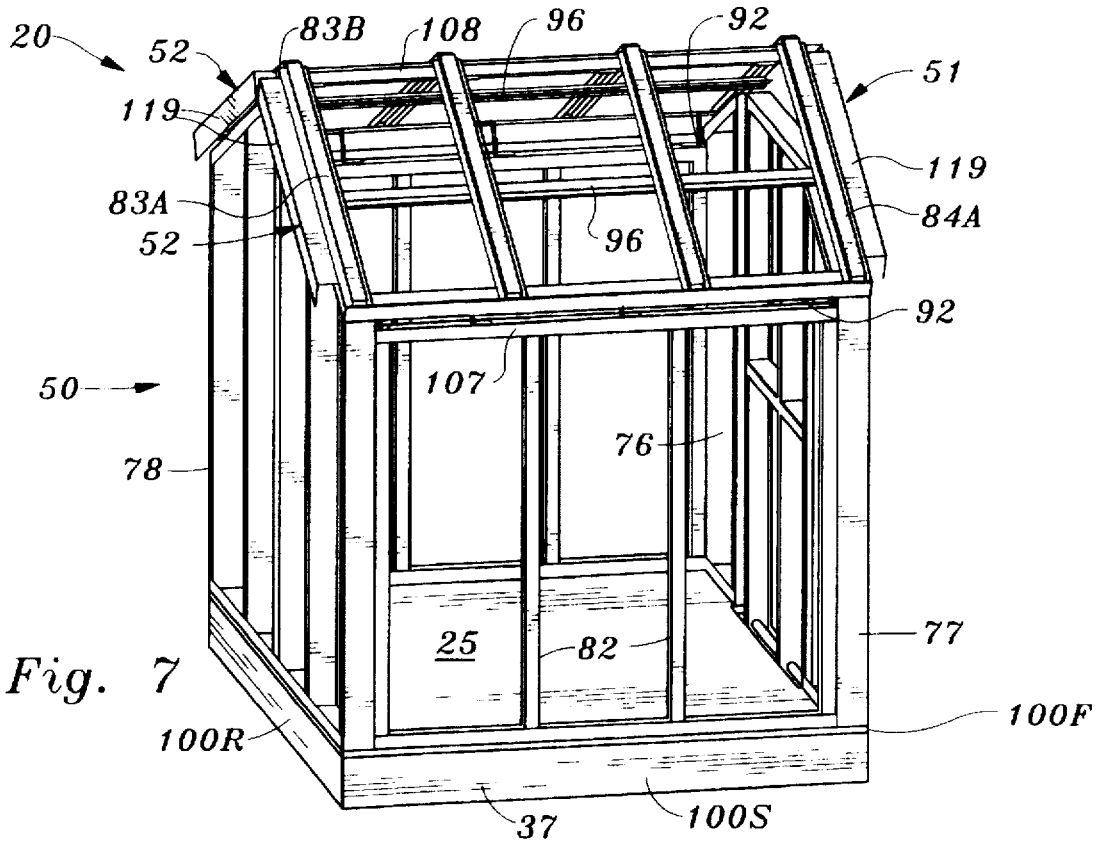
FIG. 7 is a left rear perspective view of the framework.
Figure 12:
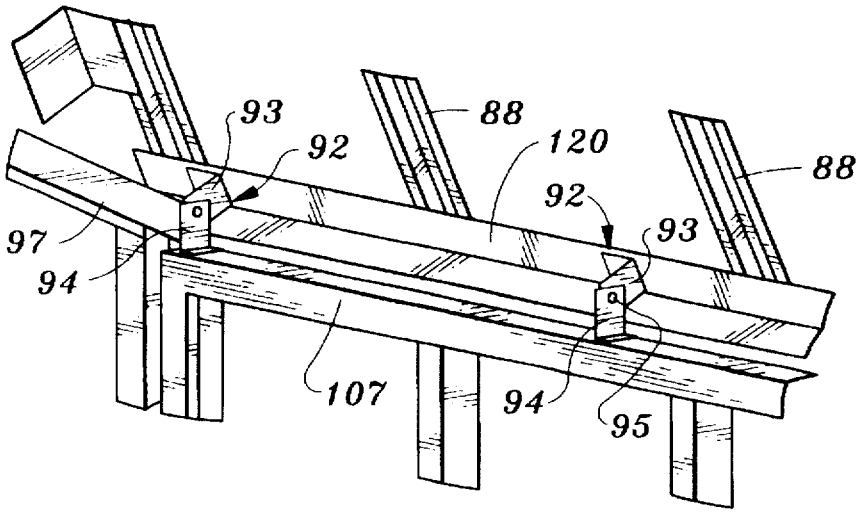
FIG. 12 is a close-up view showing the hinging of a roof portion.
Figure 13:
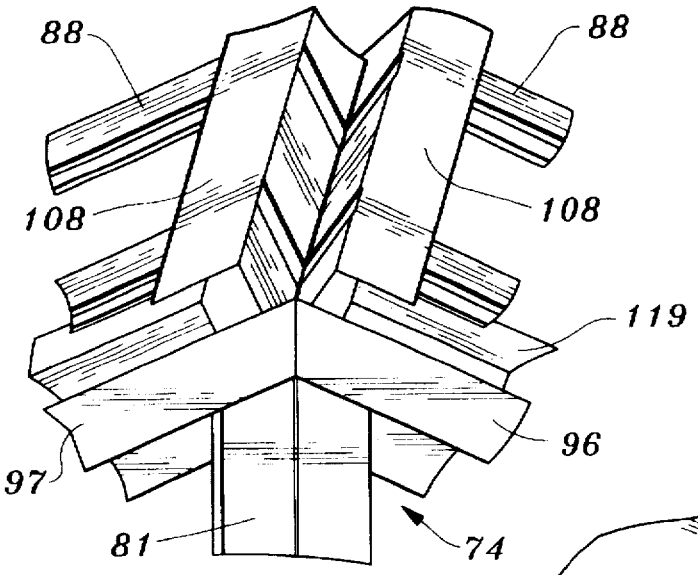
FIG. 13 is an inside perspective view showing some of the frame members of the roof portion.

Each of the sections 52 is pivotally mounted as is seen in FIGS. 7, 12, and 13 among others. Thus reference is made to element 92 in FIG. 7, the roof pivot mount. A plurality of such pivot mounts are employed, one every two to three feet along the length of the roof. Each such pivot bar 92 is seen in FIG. 12 to comprise first and second L-shaped members, 93, 94 one straight up the other inverted. The horizontal section of the upper pivot bar 93, is secured to the roof connector bar 120 between 2 hat tracks 88. This bar could in the alternative be another roof horizontal member similar to element 96 which is hat track. The second or lower pivot member 94 is secured in its horizontal section to the cross beam 107. The two pivot bars are interconnected along their vertical sections by a pin or pivot 95. Note FIG. 12 in particular.

FIG. 13 is an interior view looking upwardly of a portion of the rear of the superstructure 74. That view particularly shows the presence of the dual ridge boards 108 just discussed which form part of the roof superstructure section, 73.

Figure 11:
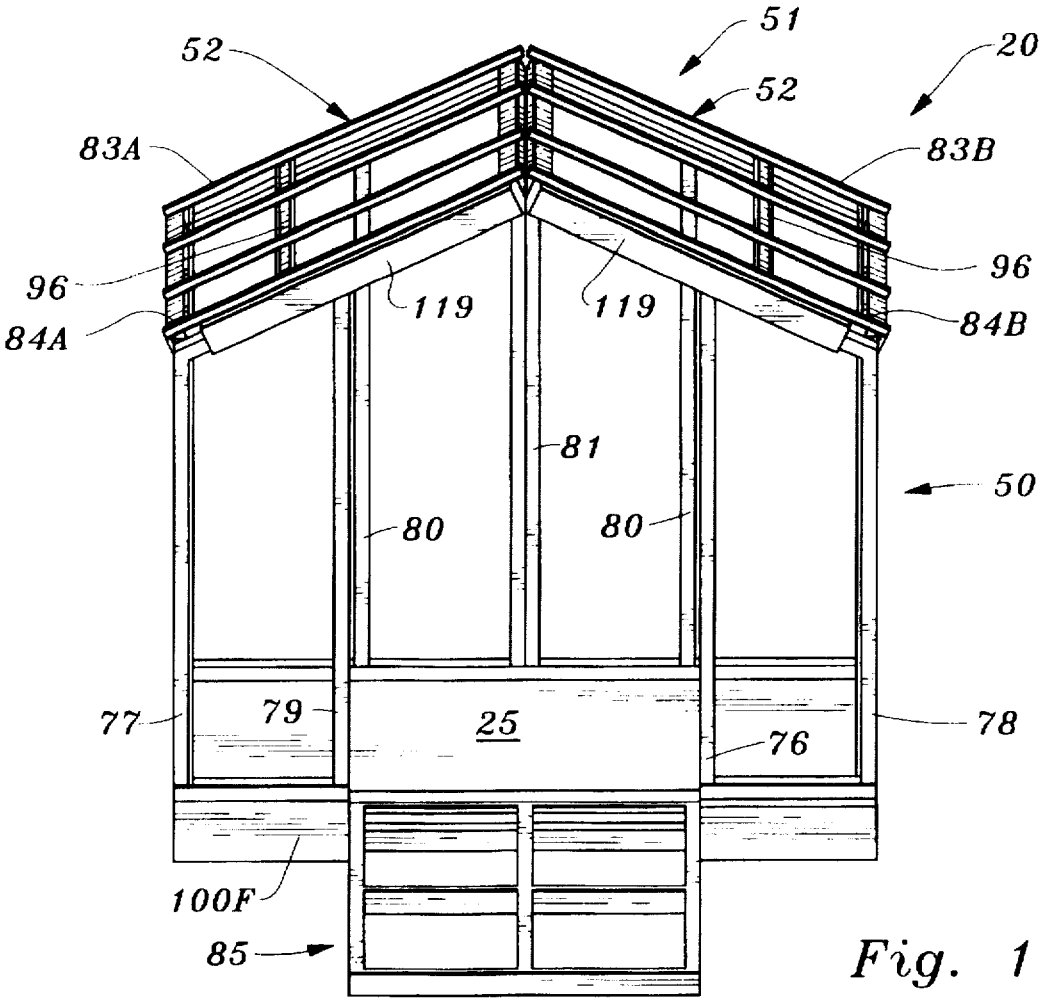
FIG. 11 is a front top perspective showing the front ramp framework down.
Figure 14:
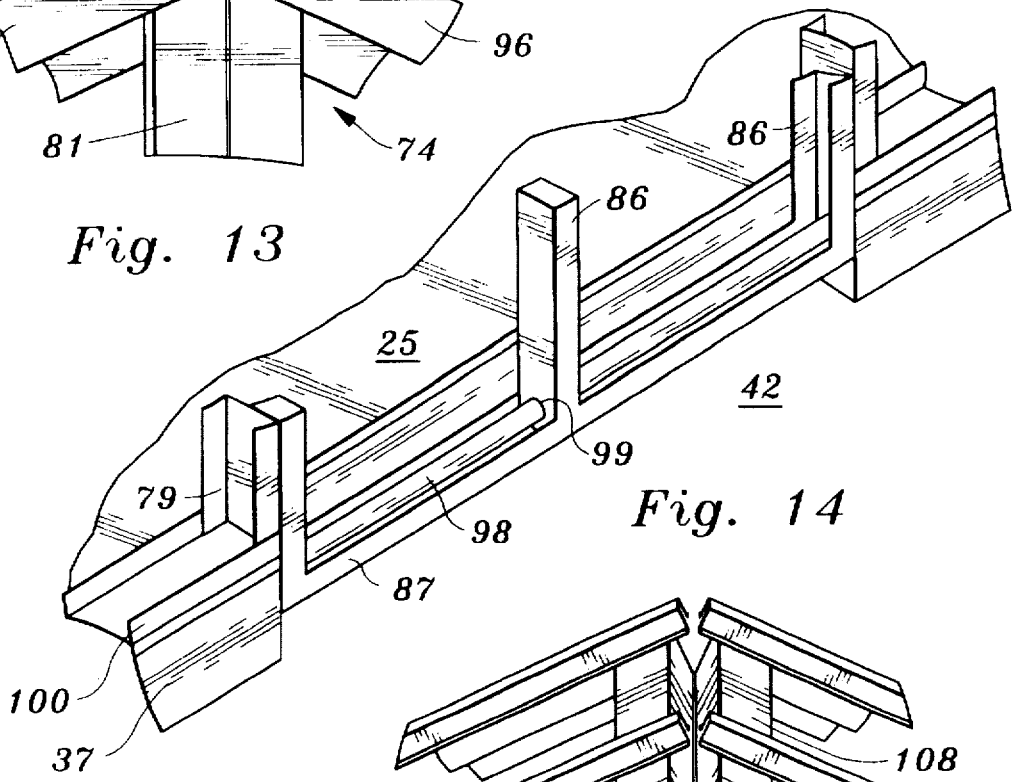
FIG. 14 is top perspective view showing a part of the floor and a part of the door portion.

FIG. 14 serves to further point out that the floor 25 is spaced upwardly form the ground 42 an amount equal to the elevation of the floor supports 37, usually 3 to 6 inches. Here a ramp is utilized to close off the front entry to the shed. Thus also seen is pivot pin 98 which is normally not seen when the ramp/door 29 is fully made, i.e., the superstructure thereof is enclosed as per FIGS. 4 and 5. Pivot pin 98 rests in the lowermost horizontal member 86 and is disposed through the holes 99 in vertical members 87 for its ends to be disposed in the two front interior studs 79, in conventional manner. While a single pivot pin is depicted and preferred, two shorter ones, one at each side of the central vertical member 87, might cause a sag in the middle of the ramp after a short time. If desired the pivot pin(s) may extend through the vertical members 87 into base member supports 100, which are connected to both vertical members 87 and the corners 75, 76. Such members are also seen in FIG. 11.

Figure 15:
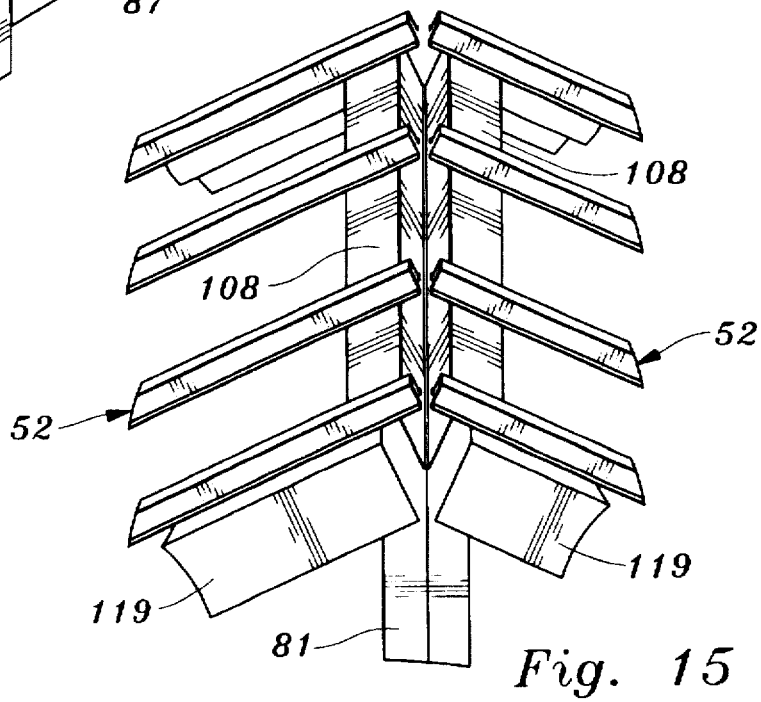
FIG. 15 is an opposite view of FIG. 13 taken from the top of roof frame members.
Figure 16:
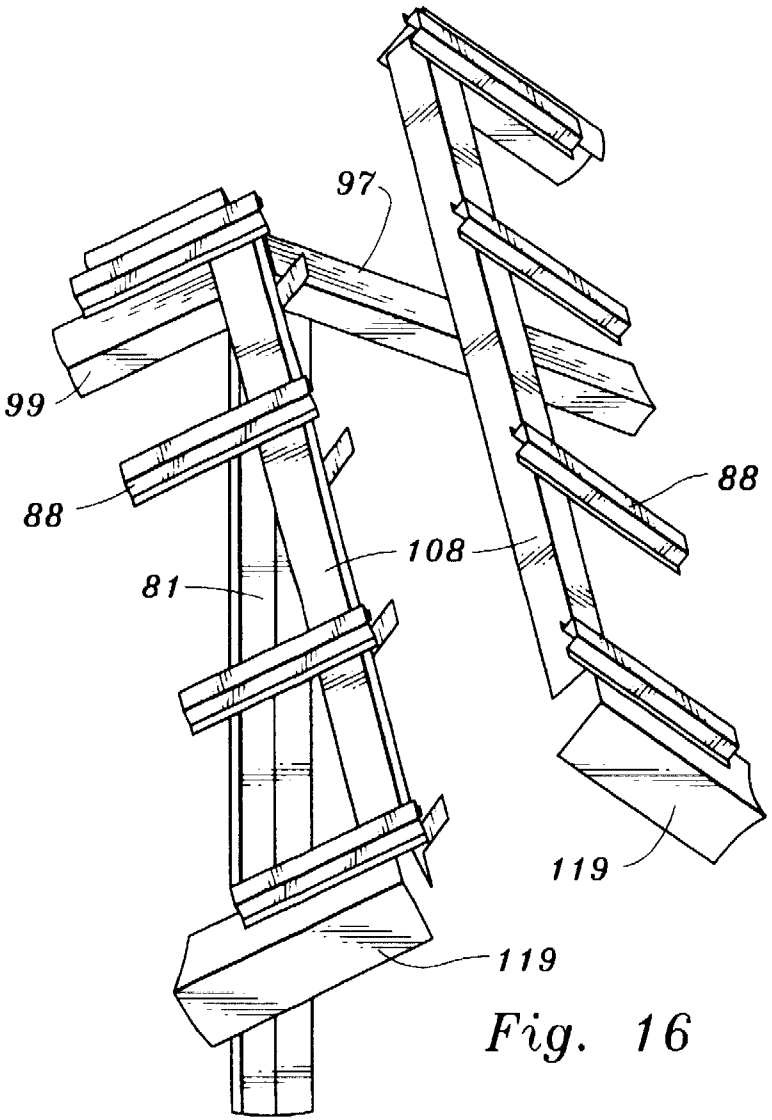
FIG. 16 is a close-up view showing the ridge boards of the roof framework.

The next figure for discussion is FIG. 15. This view is a top perspective view of the roof of the shed of this invention. This view serves to illustrate the mounting of the twin ridge boards 108 to the undersides of the spaced hat track roof rafters. In FIG. 15, where fascia 119 is also seen the two roof sections are in an almost closed position. Contrast FIG. 15 with FIG. 16, taken from the same vantage point at a later point in time, wherein the roof is in a partially open position. In neither of these views is the roof cap 32 depicted as it is mounted over the roofing 53 of each roof section 52, which sections taken together the roof superstructure 73.

Figure 17:
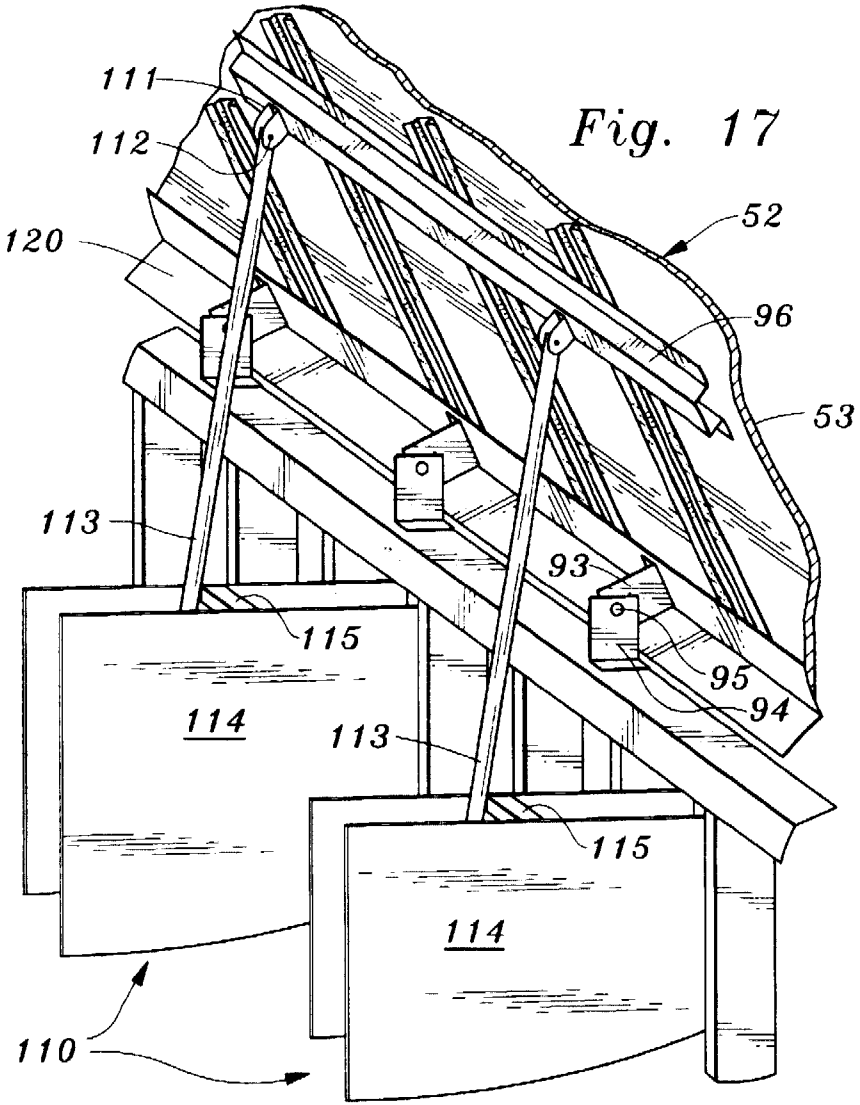
FIG. 17 is an interior view of the shed of the invention showing a portion of the elevating mechanism for the roof.

Thus reference can now be made to FIG. 17, a view of the full size shed of this invention. Here one roof section 52 is seen with its roofing 53 mounted to the spaced roof rafters 88 and the horizontal hat track sections 96 and the pivot connector bar 95. While only one hat tack 96 is shown, it is within the scope of the invention to utilize a plurality of spaced members 96.

The roof 53 may comprise any of a sheet of exterior plywood, or dense foam covered with tar paper and asphalt shingles. Plywood is preferred due to its large sheet size and relatively lower cost. Metal or even plastic sheets could also be employed if desired.

Figure 18:
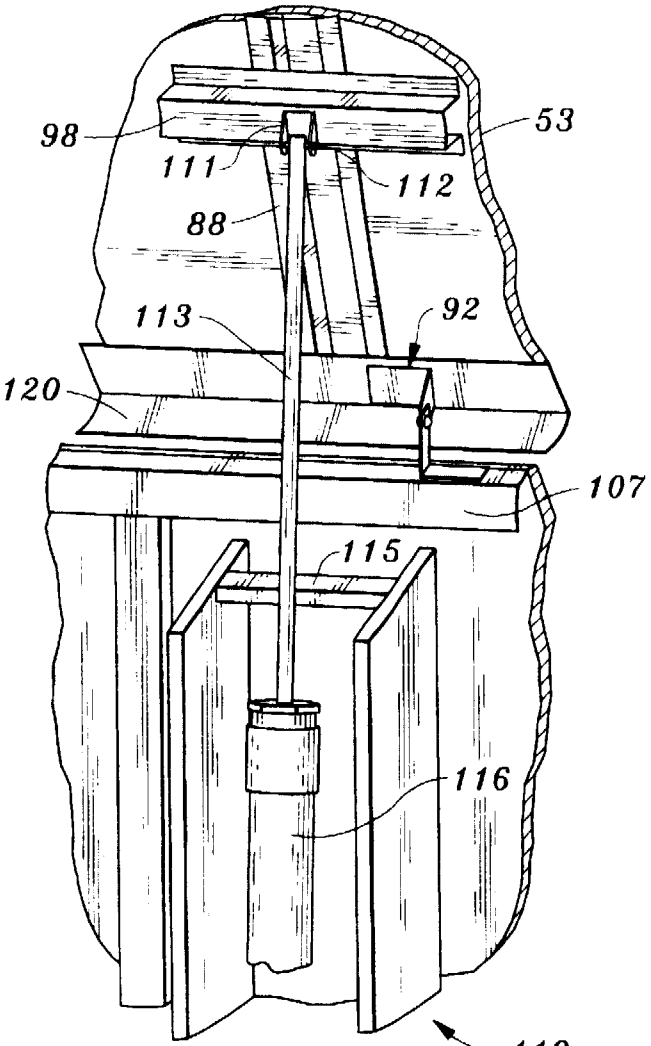
FIG. 18 is a closeup view of one of the rams utilized to raise the roof.

Also seen in FIG. 17 as well as in FIG. 18 are the ram housings 110. Seen disposed upwardly from the housing 110 is piston rod 113 attached to a piston connector plate 111 by a pivot pin 112. Two of each of these are shown in FIG. 17.

Each housing 110 is formed of a pair of spaced front and rear main plates 114, with one or more cross plates 115 connecting them. In FIG. 18, ram 116 is seen. This is a conventional hydraulic ram, having a single fluid inlet and outlet, which is not seen. When fluid is moved from a source not seen to the ram, piston rod 113 moves outwardly and upwardly thereby opening the roof section 52. When fluid is withdrawn, the piston rod 113 retracts, thereby closing the roof section 52. Such rams are deemed conventional.

Figure 19:
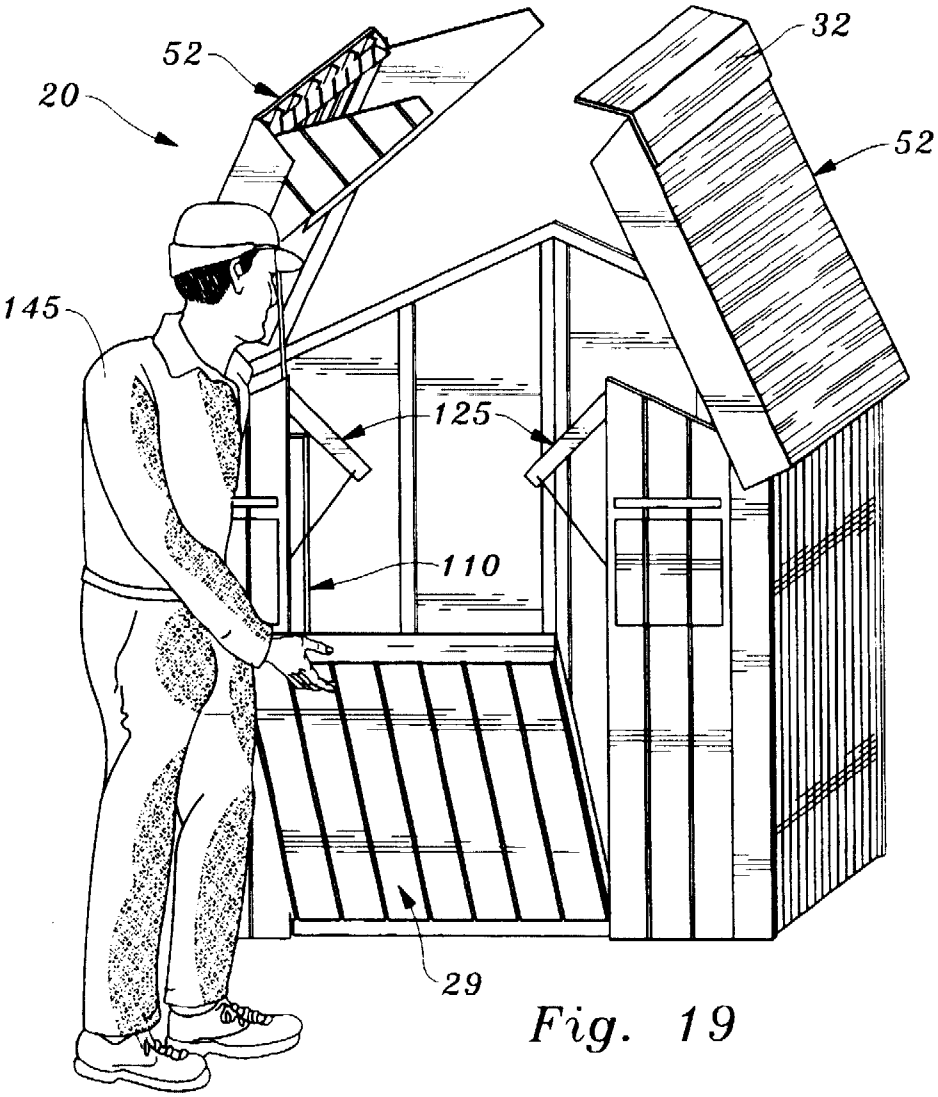
FIG. 19 is a front perspective view of this invention with the front door part way down and the roof open, and the retention member for the roof in place.

FIG. 19 is a front view of the shed of this invention, with the two roof sections 52 open and the front ramp 29 in the process of being lowered by a user, 145.

Figure 20:
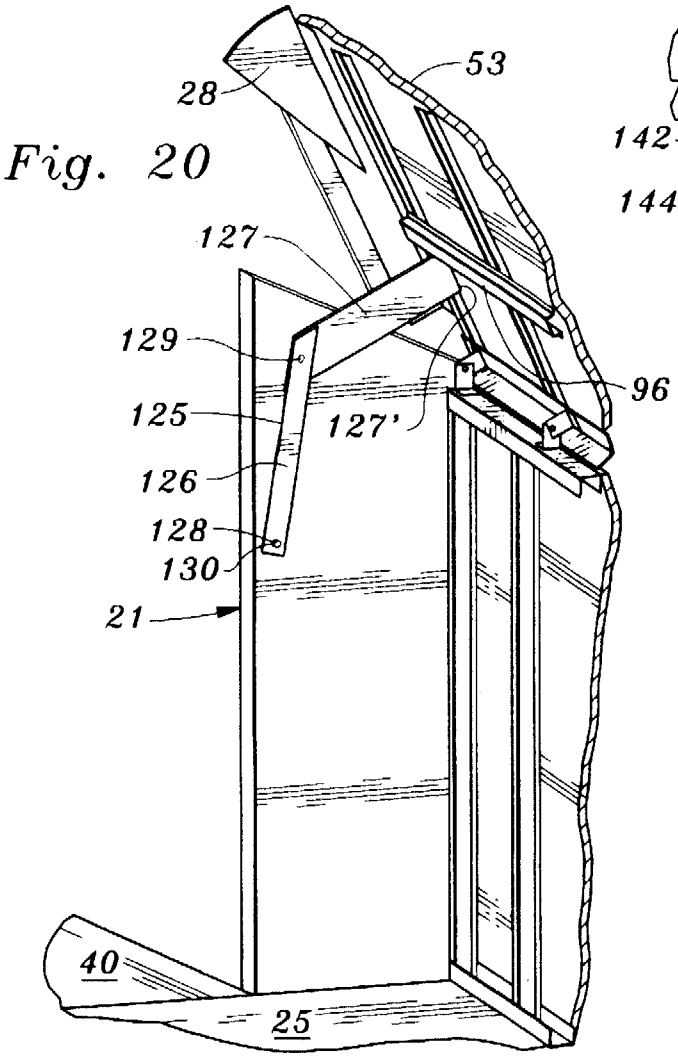
FIG. 20 is a close-up of a retention member used to safely hold the roof portion open.

When the roof section 52 is open such that user 145 can walk into the shed 20, it is deemed beneficial to take steps to avoid the accidental loss of pressure of the plurality of cylinders 116 by providing a supplemental roof support 125 as shown in FIG. 20. This support 125 includes a handle 126 connected to an angled latch 127, the unit being pivotally mounted by pin 129 to a ram housing 110, but preferably to the front end wall's interior surface. The latch 127 face 127' will rest against either one of the hat track sections 88, or the roofing 53 depending on the relative disposition of the ram housing. To ensure that the roof support 125 stays in its place, a throughbore 128 communicates with another bore, not seen in the mount site. Pin 130 is inserted via throughbore 128 into the bore in the mount site to secure the roof support in an engaged position as shown in FIG. 20.

Figure 27:
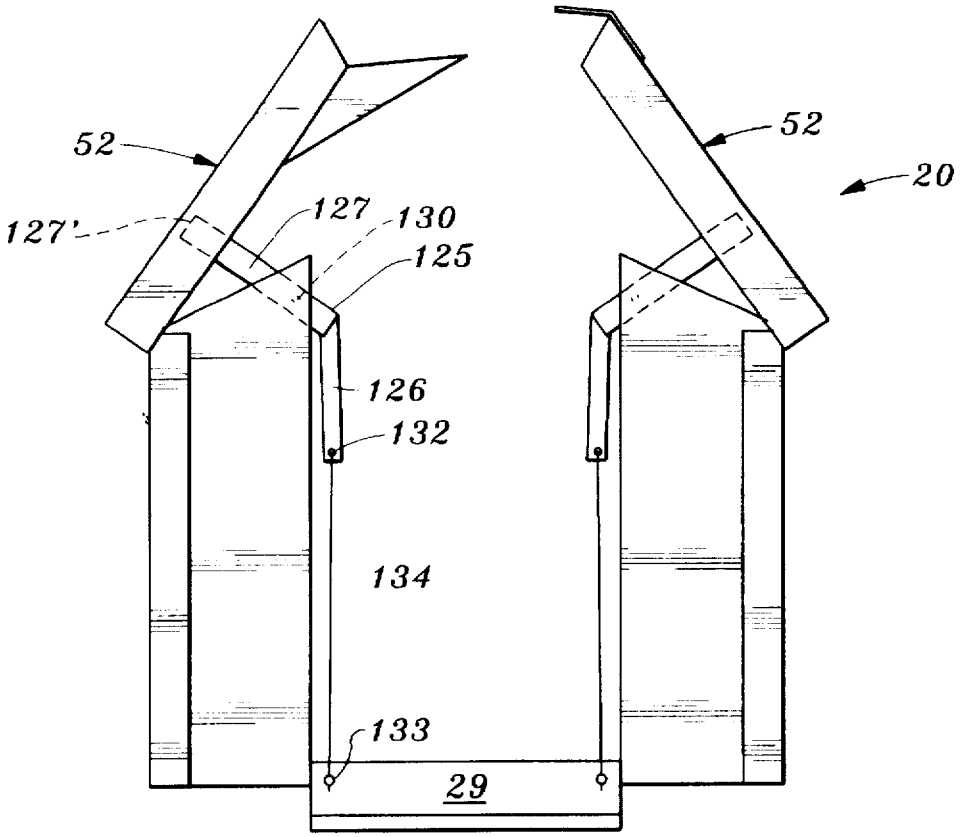
FIGS. 27 and 28 are diagrammatic depictions of the operation of the preferred mode of operation of the safety latch to retain the roof in an open position.
Figure 28:
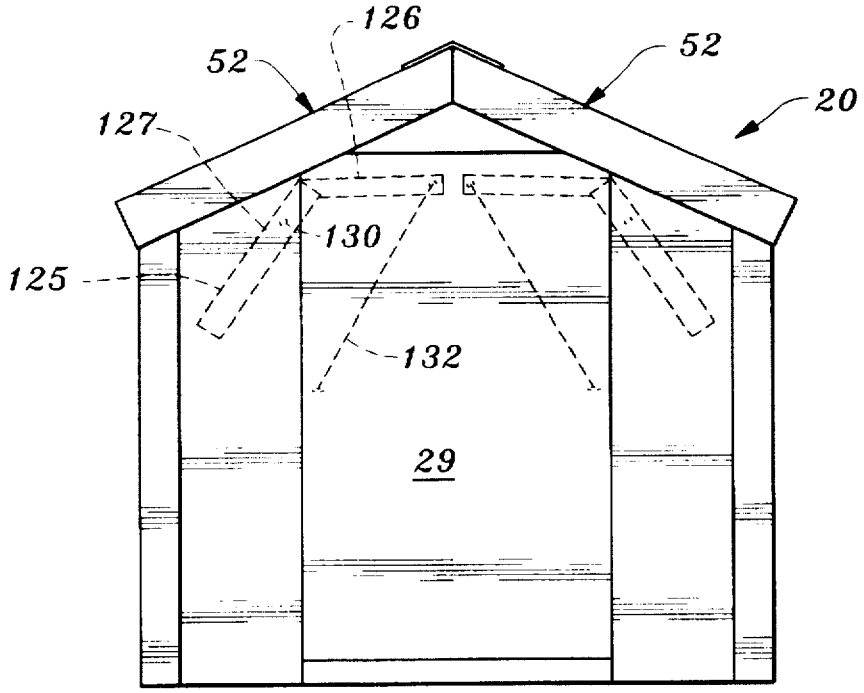

Reference is now made to FIGS. 27 and 28. While the safety latch can be operated manually as discussed infra, from a safety point of view, it is better if this latch is raised automatically. Such can be accomplished by use of the hookup shown in FIGS. 27 and 28. While the roof support 125 is mounted in the manner previously discussed, and preferably to the front end wall, such that a repeat discussion is not needed, three additional elements are employed. Thus an eye 132 is mounted to the face of the handle 126 on the face thereof distal from the end wall. A similar eye is threadedly attached to the edge of the interior surface of the ramp. Such a procedure is carried out for both the left roof section and the right roof section, in mirror image fashion. A conventional metal cable 134 is connected between the respective roof support's eye and the support's side of the ramp's interior surface. See FIG. 27. Therefore when both roof sections have been raised, a lowering of the ramp as in FIG. 27 will raise the two roof supports 125 at the same time. This system acts as a quasi-interlock, in that the ramp can not be lowered, if one or both roof sections 52 are down, as the roof support is not strong enough to overcome the resistance of the non-functional ram to raise the roof section (s). See FIG. 29 which shows the relative disposition of the two roof supports and the cables when the ramp is in the retracted closed position.

If desired a similar automatically raised roof safety support system can be installed for sheds wherein the front entry is a door. Suffice it to say that both cables would be installed at about the middle of the interior surface of the door, proximate the hinges. One or more extra eyes may be needed to do so, but it is within the skill of the artisan to carry out this installation.

Figure 21:
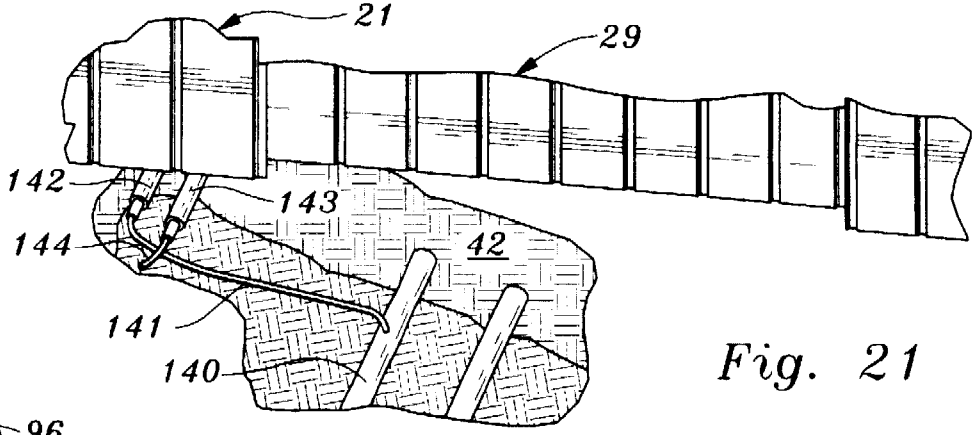
FIG. 21 is a view showing part of the hydraulic operating system used herein.

In FIG. 21 some of the dirt of the ground 42 has been removed to show the presence of the inlet water source 140, from which a flexible pipeline, 141 is connected to inlet pipe 142. This pipe 142 communicates with each of the aforementioned rams for lifting of the roof sections 52. Pipe 143 and its flex line 144 connected thereto on one end is also connected to all of the rams for the drainage of all of the rams.

Figure 22:
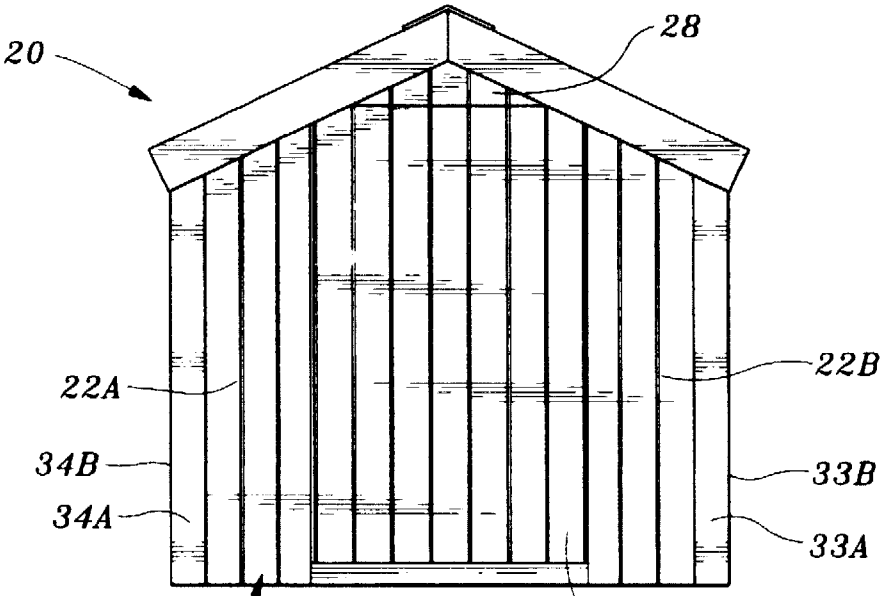
FIG. 22 is a rear elevational view of the shed of this invention.

FIG. 22 is an elevational view of the rear wall 22 of the shed (the apparatus) of this invention. Rear wall panels 22A and 22B separated by rear door 40 are seen. It is preferable to utilize a rear door rather than a ramp, as a door requires less space rearwardly for access and egress. Thus standard door hinges not seen would be employed instead of the pivot pin previously discussed in connection with FIG. 14. To save construction costs, the rear door 41 may be made the same size as the front ramp aforesaid, such that the same triangular above door section 28 may be employed at the rear of the building as well. As mentioned earlier, no door or ramp is required such that a solid panel is employed for there.

Figure 25:
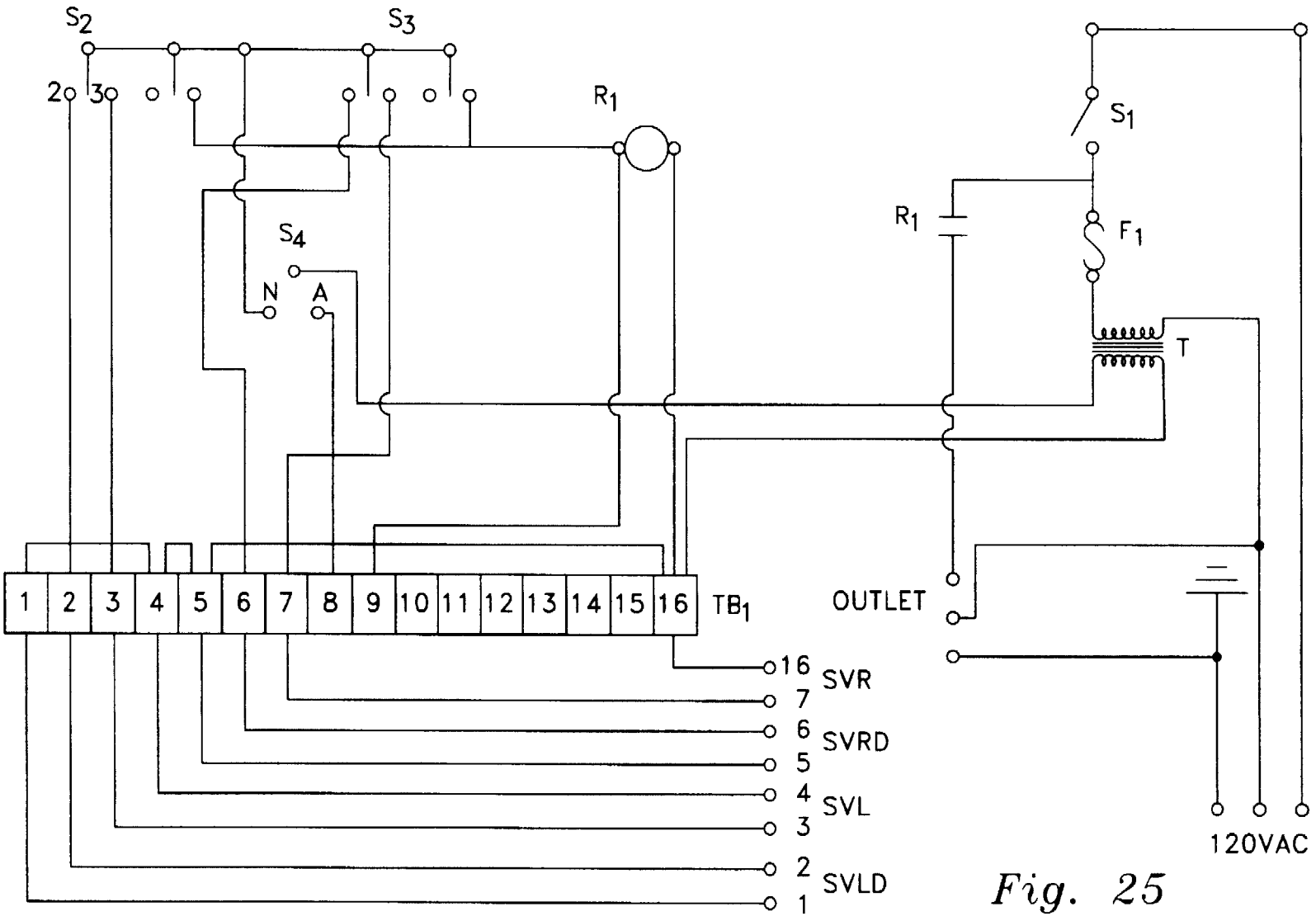
FIG. 25 is a schematic diagram for the electrical operation of the rams employed as part of this invention.

While the unit has been discussed supra as being hydraulically operated, using ordinary water as the hydraulic fluid, the rams required herein can also be electrically operated. FIG. 25 is a schematic diagram illustrating the circuitry required for such operation.

For electrical operation, the water lines discussed with respect to FIG. 22 are of course omitted. In addition, the hand valves utilized to open and close the roof sections 52 are deleted. A control panel, seen in FIG. 24 which contains visible switches, and not seen optional transformer, fuses or circuit breakers, and suitable relays is installed, preferably on the right front wall as shown. An air compressor and one solenoid per ram are suitably disposed inside the shed. It is within the skill of the art to correctly wire the two switches and optional transformer depending upon the voltage of the circuit, to actuate the air compressor and associated solenoids to operate the fluid based rams using air as the fluid to thereby raise the roof. Other solenoids actuate the valves to bleed the rams of fluid when so desired. Any suitable single acting fluid operated ram may be employed to open the roof sections.

Figure 23:
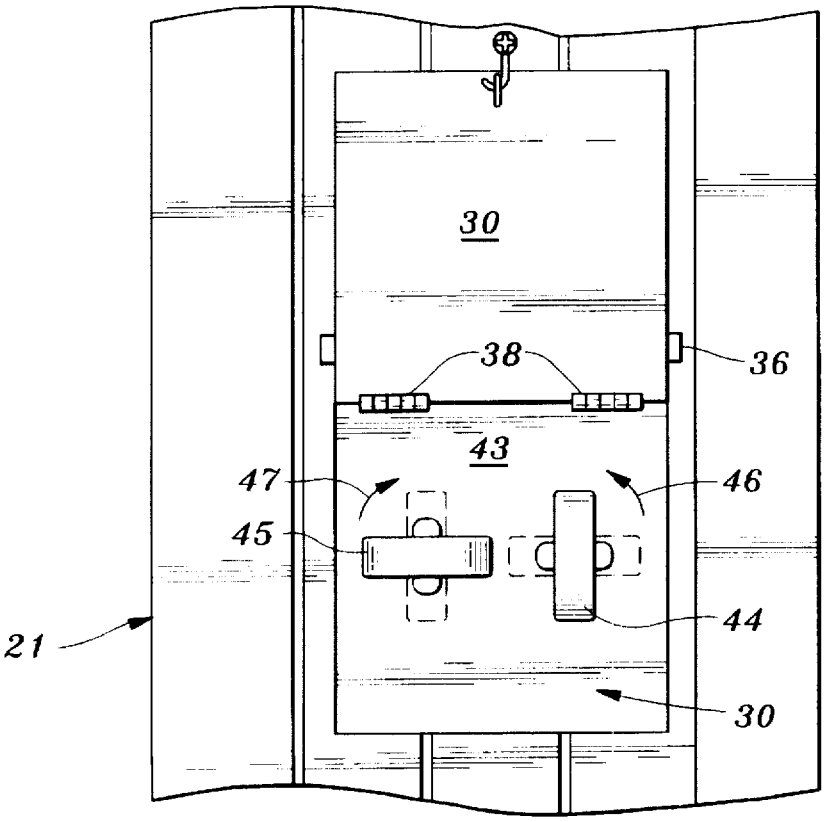
FIG. 23 is a close-up elevational view of one of the valve panels for the hydraulic opening the roof of the invention.
Figure 24:
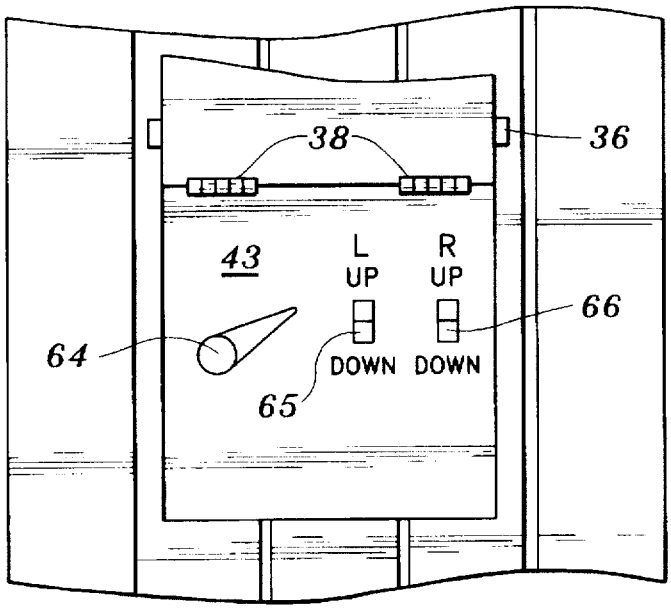
FIG. 24 is a close-up elevational view of the electrical panel for the electrical operation of the roof of the invention.
Figure 26:
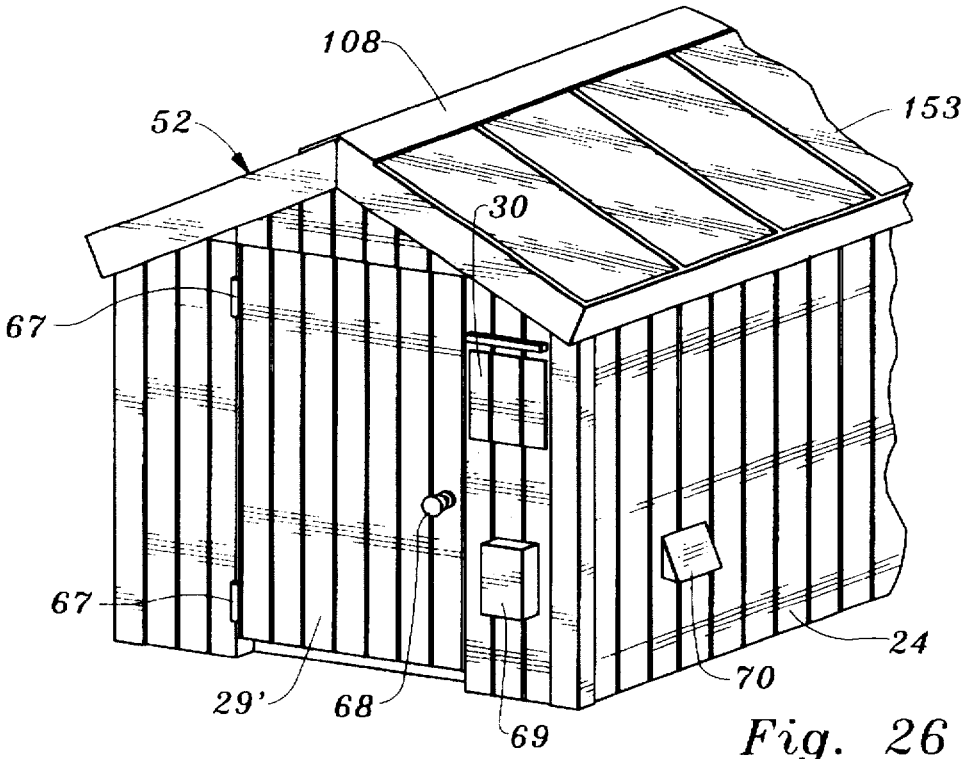
FIG. 26 is a perspective view of a greenhouse made in accordance with this invention.

The control of the operation for access to the structure of this invention when used as a storage or related building is discussed infra with respect to FIGS. 23–25. In FIG. 26, which is a partial perspective view of a building according to this invention, the purpose of the building is as a greenhouse. Since like numbers will refer to like parts, duplicate discussions will not transpire for most of this structure.

Thus in FIG. 26, the front ramp is seen to be in the format of a door 29' held in place by conventional hinges 67 and utilizing a knob set 68 to control entry and egress. Alternatively a ramp 29 as previously discussed may be utilized as well. In this embodiment which also has two roof sections 52 and a ridge board 108, the roofing instead of being plywood is either glass or transparent plastic such as UV-ray inhibited acrylic, polyvinyl chloride, or polycarbonate panels. The elevation of the roof is seen here to be preferably by electricity and therefore only one access panel 30 is depicted. If desired an extra switch within the skill of the art may be added to permit temperature activated roof opening in addition to the manual operation described elsewhere herein. While the ram controls be they electrical or hydraulic may be directly attached to the front wall through suitable throughbores, it is also within the scope of the invention to provide an opening slightly smaller than the access panel such as 30, place the controls on a separate piece of wood, slightly larger in width and height than the opening, and attach the piece of wood over the opening, from the interior of the structure.

Conventional sprinkler controls as for a drip system are disposed within box 69 attached to the front wall of the structure. It is also suggested that the interior side walls 23,24 as well perhaps as the front and rear walls, be treated as by covering or spraying the surface of the walls to prevent water damage. Optional air vents such as 70 may be strategically located throughout the structure. The exact locations are within the skill of the art.

BUILDING ACCESS

As noted previously the building 20 of this invention is of a shorter elevation than most adults. The first to be discussed is the hydraulic fluid or water operated model. The user 145 would face the front wall 21 of the structure 20. He/she would be adjacent the right access panel 30, which is pivotally mounted to the panel protector 36 by hinges 38, per FIG. 23. Behind the access panel 36 is the control panel 43 upon which are the operation valves to control the right roof section 52. Panel 35 and the second control panel 43 which are both similar to those mentioned will not be discussed to avoid duplication of effort.

In order to raise the roof the right valve 44 is rotated from a vertical to a horizontal position to the dashed line indicator according to directional arrow 46. The left valve 45 is rotated from the horizontal to the vertical position. When the right roof section 52 reaches the desired point in opening, usually the maximum elevation, one closes the left valve 45, i.e., it is rotated according to arrow 47 to a dashed line vertical position.

This operational procedure is repeated on the left side of the structure. That is the first valve 44 is opened, the roof raised to an elevation, then rotate valve 45 for 80 degrees.

Grasp the ramp 29, and lower it to the ground 42 such that the inner panel 40 is facing upward. Any optional safety stops should be engaged.

After placing in or removing articles from within the confines of the building 20, the procedure is reversed to close down the roof sections 52, but not till after the ramp 29 has been picked up and returned to the upward position between the front wall sections 21. The left valve access panel 31, which is not depicted in an open position as it is similar to the right one discussed supra, is visited. Return valve 44 to a vertical position. When left roof section 52 has been lowered, close valve 45 by counter-rotation. Do the same for the right side pair of valves to close the right roof section 52. It is important to note that the right section must be opened first and closed second, whether hydraulically or electrically, since roof cap 32 is mounted here on the right roof section. See FIG. 5.

The electrically operated manual control only system requires one access panel but two may be used by splitting the location of the switches. However, for cosmetic purposes a second dummy panel may be employed. Just as the valves 45 and 46 would be mounted to the wall behind the access panel, so too the electrical switches employed here are similarly mounted.

The discussion turns now to FIG. 24, wherein only the electrical control panel 43' is seen—the access panel not being shown. Main power switch 64 is a typical on-off toggle switch. The roof control switches, 65 for the right roof section and 66 for the left roof section are both center off reversing toggle switches. To open an electrically operated ram roof shed, after raising the panel 36 for access, one first turns on the master power switch 64, raises the right roof section 52 by moving switch 66 to the up position, and when the roof is opened as desired, the switch 66 is lowered to the central neutral position. The switch 65 is moved to up, to raise the left roof section, and on achieving the proper elevation, the switch 65 is returned to the central neutral position.

Access to the greenhouse embodiment is carried out in the same manner as the previously described electrically operated roof unit. However rather than lowering a ramp, 29, one turns the doorknob of door 29'. If a temperature controlled access to the environment is desired then an additional switch not shown which is temperature responsive can be added to the control panel.

MATERIALS

The structures of this invention can be built with readily available materials. The floor and end walls utilize 4" metal 18 gauge studs, while the sidewalls may be formed of 1.625 inch studs of 20 gauge metal. Metal hat track and bar stock ½ inch thick is suggested for the roof. Any exterior siding of about ⅛th" thick at least is recommended. CDX plywood covered with at least a coat of paint and preferably with a composition roofing overlayment is suggested for the roofing of the storage building, and clear PVC or acyclic panels are recommended for the greenhouse roofing. Other metal components should be of 25 gauge stock at minimum.

The actual mode of construction is similar to that used in the building of a house. That is the superstructure is put up using standard fasteners, such as wafer head self-tapping #8 screws, while the siding and flooring is put into place using #8 self-tapping screws of perhaps 1.25 inches in length. All other assembly utilizes commonly available fasteners readily apparent to the skilled craftsman.

The inclusion of windows, air conditioning, storage shelves and other features that have no affect on the underlying construction of the structure are all within the purview of this invention. Plumbing pipes etcetera are conventional PVC components readily available in the marketplace.

It is seen that I have provided a unique structure that can be built any length from say about 4 feet deep to about 20 feet deep, or longer as may be desired. The shed may have an opaque roof or a transparent roof or even a translucent roof as may be desired. The roof can be raised electrically or hydraulically to permit access after the front door is opened or the front ramp is lowered. But in no event will the structure be visible from the opposite side of a boundary fence.

It is contemplated that the sidewalls would be about 4 foot high with the peak of the ridge board being about another foot high. These are only suggested dimensions. Thus if regulations permit an 8 foot fence, the side walls could be 5.5 foot high and the roof incline could be bigger, especially in snow zones where it would be desired for the snow to fall from the roof by gravity.

Figure 29:
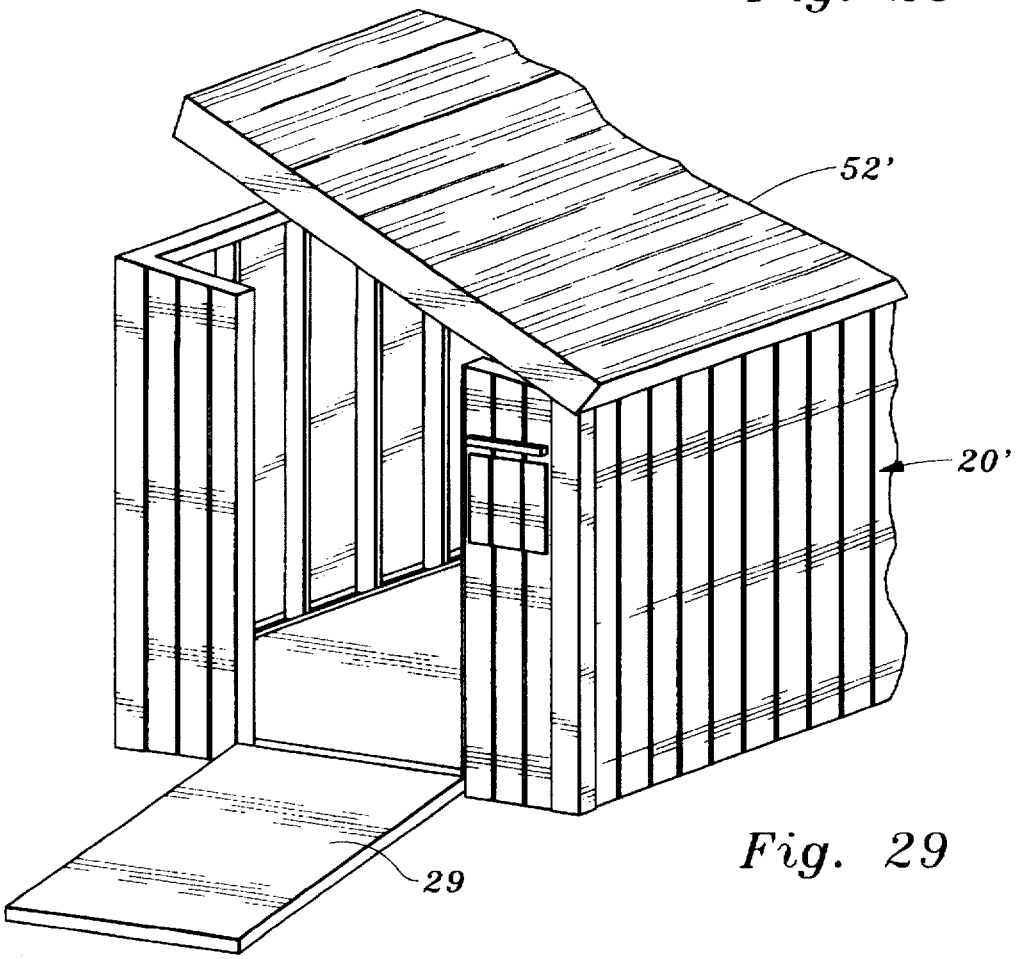
FIG. 29 is a perspective view of a variant of the shed of this invention, with but one roof portion, which roof portion is depicted partially open, and the ram p of the shed is shown in its lowered position.

While all of the discussion and the drawings herein depict a peak roof shed, with two operable roof sections, it is readily seen that if one makes one side wall higher than the other, and by suitable adjustment of the configuration of the front and rear walls, that a shed having a single sloping roof section can be constructed. It is readily within the skill of the art to make these adaptations, and such a building is shown in FIG. 29. Since the construction and operation of this shed are the same as previously discussed, with only the cosmetics being different no detailed further discussion is needed. Suffice it to say that such a building only needs one set of rams and ½ the controls of the two roof portion building .

Since certain changes may be made in the above apparatus without departing from the scope of the invention herein involved, it is intended that all matter contained in the above description, shall be interpreted as illustrative and not in a limiting sense.

I claim:

1. A portable storage shed having an operable roof, which shed comprises:

(A) a wall superstructure of spaced front and rear walls, and spaced side walls, said spaced side walls connected normal to said spaced front and rear walls, said front wall having a front access means therein, said superstructure's walls being covered with an enclosing material, (B) a floor connected to said superstructure (C) said shed having at least one raiseable roof portion, said roof portion being hingedly connected to the said superstructure;

(D) at least one rain disposed within said shed connected to each roof portion, (E) control means operatively connected to each said ram to operate each said ram to raise and lower each said roof portion.

2. The storage shed of claim 1 wherein the rear wall also includes an access means.

3. The storage shed of claim 2 wherein the rear access means is a door.

4. The storage shed of claim 1 wherein there are two said roof portions and the front access means is a pivotally mounted ramp.

5. The storage shed of claim 4 further including at least one pivotally mounted roof support for each said roof portion to safely retain the roof portion in an open condition in case of failure of the at least one ram to do so.

6. The storage shed of claim 1 further including at least one pivotally mounted roof support for each said roof portion to safely retain the roof portion in an open condition in case of failure of the at least one ram to do so.

7. The storage shed of claim 1 wherein each said ram is a single acting ram, that uses water as the operative fluid.

8. The storage shed of claim 1 wherein the control means is electronic and each said ram uses air as the operative fluid.

9. The storage shed of claim 1 further including a rear door disposed within the rear wall.

10. The storage shed of claim 1 wherein the at least one raiseable roof portion, comprises a roof superstructure covered with an overlayment.

11. The storage shed of claim 1 wherein there are two said roof portions and each said roof portion comprises a roof superstructure covered with an overlayment.

12. The shed of claim 11 wherein the overlayment for the roof superstructure is a transparent material.

13. The storage shed of claim 1 wherein there is only said one roof portion, and each said ram is a single acting fluid actuated ram, said roof portion comprising a covered superstructure.

14. A portable storage shed having an operable roof, which shed comprises:

(A) a wall superstructure of spaced front and rear walls, and spaced side walls, said front wall having a front access means therein, said superstructure's walls being covered with an enclosing material, (B) a floor connected to said superstructure (C) said shed having at least two raiseable roof portions, said roof portions being hingedly connected to the said superstructure;

(D) at least one ram disposed within said shed connected to each said roof portion, (E) control means operatively connected to each said ram said to operate each said ram to raise and lower each said roof portion; and further including, (F) at least one pivotally mounted roof support for each said roof portion to safely retain the respective roof portion in an open condition in case of failure of the at least one ram to do so, as well as including (G) means interconnecting said front access means and said roof supports to pivotally raise said roof supports when said front access means is in an open position, and to lower said roof supports when said front access means is in a closed position.

15. In the portable storage shed of claim 14 wherein the front access means is a pivotally mounted ramp which moves from an up closed position to a down open position.

16. The storage shed of claim 14 further including a rear door disposed within the rear wall.

17. A portable storage shed having an operable roof, which shed comprises:

(A) a wall superstructure of spaced front and rear walls, and spaced side walls, normal thereto, said front wall having a pivotable front access ramp therein, said superstructure's walls being covered with an enclosing material, (B) a floor connected to said superstructure (C) said shed having two raiseable roof portions, said roof portion being hingedly connected to the said superstructure;

(D) at least one ram disposed within said shed connected to each said roof portion, (E) control means operatively connected to each said ram to operate each said ram to raise and lower each said roof portion further including (F), at least one pivotally mounted roof support for each said roof portion to safely retain the roof portion in an open condition in case of failure of the at least one ram to do so.

18. The storage shed of claim 17 wherein each said ram is a single acting ram, that uses water as the operative fluid.

19. The storage shed of claim 18 further including means interconnecting said ramp and said roof supports to pivotally raise said roof supports when said ramp is lowered to an open position, and to lower said roof supports when said ramp is raised to a closed position.

20. The storage shed of claim 19 wherein each said roof portion comprises a roof superstructure covered with an overlayment and the overlayment for the roof superstructure is a transparent material.

21. The storage shed of claim 19 wherein each said roof portion comprises a roof superstructure covered with an overlayment and the overlayment for the roof superstructure comprises plywood covered with a member selected from the group consisting of a coat of paint and shingle covered tar paper.

* * * * *